US011745113B2

(12) United States Patent
Utsumi

(10) Patent No.: US 11,745,113 B2
(45) Date of Patent: Sep. 5, 2023

(54) MODEL ENERGIZATION COUPLER, RAILWAY MODEL VEHICLE, AND MODEL ENERGIZATION UNIT

(71) Applicant: TOMYTEC CO., LTD., Tochigi (JP)

(72) Inventor: Shintaro Utsumi, Tochigi (JP)

(73) Assignee: TOMYTEC CO., LTD., Tochigi (JP)

( * ) Notice: Subject to any disclaimer, the term of this patent is extended or adjusted under 35 U.S.C. 154(b) by 933 days.

(21) Appl. No.: 16/560,360

(22) Filed: Sep. 4, 2019

(65) Prior Publication Data

US 2020/0070059 A1 Mar. 5, 2020

(30) Foreign Application Priority Data

Sep. 5, 2018 (JP) ..... JP2018-166381

(51) Int. Cl.
*A63H 19/18* (2006.01)

(52) U.S. Cl.
CPC ..... *A63H 19/18* (2013.01)

(58) Field of Classification Search
CPC ..... A63H 19/18; B61G 3/00; B61G 3/04; B61G 7/04
See application file for complete search history.

(56) References Cited

U.S. PATENT DOCUMENTS 2,288,792 A * 7/1942 Daniels ..... A63H 19/18 213/75 TC
2,778,508 A * 1/1957 Beger ..... A63H 19/18 213/211
5,826,736 A * 10/1998 Weber ..... A63H 19/18 213/75 TC
6,942,492 B2 * 9/2005 Alvarez ..... A63H 19/18 439/65
7,118,384 B2 * 10/2006 Alvarez ..... A63H 19/18 439/65
7,434,701 B1 * 10/2008 Freeman ..... A63H 19/18 213/75 TC (Continued)

FOREIGN PATENT DOCUMENTS

DE 102014009566 B3 * 11/2015 ..... A63H 19/18
JP 2003-038862 A 2/2003

(Continued)

OTHER PUBLICATIONS

DE102014009566B3 w/ translation (Year: 2015).*

(Continued)

*Primary Examiner* — Eugene L Kim
*Assistant Examiner* — Alyssa M Hylinski
(74) *Attorney, Agent, or Firm* — Manabu Kanesaka

(57) ABSTRACT

In a model coupler that detachably couples vehicles, energization between the vehicles in train organization is stabled regardless of curvature of a rail. A support member is swingable in line with the coupling part by extending from an attachment base side attached to a model vehicle toward a front end side facing the coupling partner and providing a front end under the coupling part. One energization part is attached to the support member and includes a first contact point formed on the attachment base side and a second contact point formed on the front end side. The first contact point is in contact with a first power collection member of the model vehicle, and the second contact point is in contact with a fourth contact point of the other energization part of the coupling partner.

17 Claims, 10 Drawing Sheets

(56) References Cited

U.S. PATENT DOCUMENTS

| | | | | |
|---|---|---|---|---|
| 7,464,824 | B2 * | 12/2008 | Utsumi | A63H 19/18 213/75 TC |
| 7,694,834 | B2 * | 4/2010 | Wolf | A63H 19/18 213/75 TC |
| 7,814,841 | B2 | 10/2010 | Hermant | |
| 8,950,606 | B2 * | 2/2015 | Dunham | A63H 19/18 213/75 TC |
| 2004/0182812 | A1 * | 9/2004 | Alvarez | A63H 19/18 213/75 TC |
| 2005/0255721 | A1 | 11/2005 | Alvarez | |
| 2009/0014402 | A1 * | 1/2009 | Wolf | A63H 19/18 213/75 TC |
| 2011/0253664 | A1 | 10/2011 | Grubba | |
| 2014/0001141 | A1 * | 1/2014 | Dunham | A63H 19/18 213/75 TC |

FOREIGN PATENT DOCUMENTS

| | | | |
|---|---|---|---|
| JP | 3802307 | B2 | 7/2006 |
| JP | 2008-061972 | A | 3/2008 |
| JP | 2008-922213 | A | 9/2008 |
| JP | 2008-245918 | A | 10/2008 |
| JP | 2014-045877 | A | 3/2014 |
| JP | 2014-155584 | A | 8/2014 |
| JP | 2018-029930 | A | 3/2018 |
| KR | 200204405 | Y1 * | 11/2000 |

OTHER PUBLICATIONS

KR200204405Y1 w/ translation (Year: 2000).*

"Can this energizing coupler be used? (この通電カプラー、使えるか ?)," Back Salomania (裏サロマニア), Jul. 16, 2018, URL: https://blog.goo.ne.jp/satokawa_157/e/5bdf0cb05df727d21a598338f6c888dd. Accessed Dec. 11, 2018.

"JR E6 series Akita Shinkansen (Super Komachi) (J R E 6 系秋田新幹線 (スーパーこまち) )," TOMIX N information room (TOMIX N 情報室), Jul. 22, 2013, vol. 1, No. 163, URL: https://www.tomytec.co.jp/tomix/report/n/nj_163.htm. Accessed Dec. 12, 2018.

* cited by examiner

MODEL ENERGIZATION COUPLER, RAILWAY MODEL VEHICLE, AND MODEL ENERGIZATION UNIT

RELATED APPLICATIONS

The present application is based on, and claims priority from, Japanese Application No. JP 2018-166381 filed Sep. 5, 2018, the disclosure of which is hereby incorporated by reference herein in its entirety.

BACKGROUND

Technical Field

The present invention relates to a model energization coupler, a railway model vehicle having the same mounted thereon, and a model energization unit used together with a coupling unit, and particularly to an energization mechanism between model vehicles in train organization.

Related Art

In the related art, a model energization coupler that detachably couples the vehicles while performing the energization between front and rear vehicles in the train organization in order to suppress knocking of a motor caused due to dirt and flickering of headlights or indoor lights is known. For example, JP 2018-29930 A discloses an energization body-mounted coupler of an N gauge railway model. This coupler has an appearance shape that is modeled on an actual automatic coupling type or tight coupling type coupler, and bipolar contact plates are provided on both side surfaces thereof. Then, in a state in which the couplers are coupled, each contact plate is electrically in contact with the contact plate of the coupling partner, and thus, the energization between the vehicles is realized.

Further, J P 2014-45877 A discloses an energization automatic coupling type coupler of an N gauge railway model which is similar to a real vehicle. The coupler mainly includes a frame, a hook, and a base, and has an outer shape that is modeled on an actual automatic coupling type coupler. The frame and the hook are made of an electrically conductive material, and the base interposed therebetween electrically shields the frame and the hook. The frame, the hook, and the base are movably connected by split pins, and are integrated as a coupler. In a state in which the couplers are coupled, the frame of the coupler and the hook of the coupling partner are in contact with the hook of the coupler and the frame of the coupling partner, and thus, the vehicles are electrically connected.

Furthermore, JP 3802307 B does not relate to the coupler that detachably couples the vehicles, but discloses a vehicle model coupling device that fixedly couples the vehicles, that is, couples the vehicles in a non-detachable manner, as in a two-vehicle coupled type electric locomotive, for example, EH500 type. This coupling device mainly includes a characteristic drawbar that enables the expansion and contraction of a vehicle distance according to the curvature of the rail, and an energization spring for electrically connecting the vehicles is provided at the drawbar.

SUMMARY

However, as in JP 2018-29930 A and JP 2014-45877 A described above, when a body of a coupling part that is attached to or detached from the coupling partner has an energization function, as the curvature of the rail becomes larger, contacting between contact points becomes unstable, and there is a possibility that a non-energization state is to occur. This is because design restrictions are severe when there is an attempt to dispose the energization mechanism without hindering the coupling function, that is, a movable mechanism of the coupling part. This problem is noticeable in the N gauge in which a rail with an extremely tight curve having a minimum radius of, for example, 243 mm is present as a standardized commercial product in addition to a small size of the coupling part itself.

The present invention has been made in view of the aforementioned circumstances, and an object of the present invention is to stabilize energization between vehicles in train organization in a model coupler which detachably couples the vehicles.

In order to solve the problems, a first invention provides a model energization coupler that includes a coupling part, a support member, a first energization part, and a second energization part. The coupling part has a front end shape detachably engageable with the same kind of coupling partner regardless of an orientation. The support member is swingable in line with the coupling part by extending toward a front end side facing the coupling partner from an attachment base side attached to a model vehicle and providing a front end formed under the coupling part. The first energization part is attached to the support member, and includes a first contact point formed on the attachment base side and a second contact point formed on the front end side. The first contact point is in contact with a first power collection member of the model vehicle. The second contact point is in contact with the fourth contact point of the second energization part of the coupling partner. The second energization part is attached to the support member in a state of being insulated from the first energization part, and includes a third contact point formed on the attachment base side and a fourth contact point formed on the front end side. The third contact point is in contact with a second power collection member of the model vehicle. The fourth contact point is in contact with the second contact point of the first energization part of the coupling partner.

Here, in the first invention, it is preferable that the fourth contact point protrude forward of a coupling surface of the coupling part and forward of the second contact point. The first energization part may be attached to one side portion of the support member, and the second energization part may be attached to the other side portion of the support member. In this case, it is preferable that a front end portion of the first energization part be bent downward and a front end portion of the second energization part is obliquely widened sideward.

In the first invention, the support member may include a protrusion that partially extends toward the front end side. The protrusion protrudes forward of a coupling surface of the coupling part, and supports a front end portion of the first energization part. In this case, the protrusion of the coupling partner is accommodated in a space present on a side of the protrusion, and a front end portion of the second energization part is disposed so as to be separated sideward from the protrusion. Further, in this case, it is preferable that movement of the support member be restricted by bringing the protrusion of the coupling part into contact with the protrusion of the coupling partner in a state of being coupled to the coupling partner.

In the first invention, the model energization coupler may further include a biasing mechanism that biases the support member to a centering position. In addition, a front end surface of the support member may have a shape that is modeled on an appearance of an electrical coupler of a real vehicle. In this case, it is preferable that at least one of the first energization part and the second energization part be slidable and be switchable between a state of protruding from the front end surface of the support member and a state of being accommodated in the support member.

In the first invention, the coupling part may be attached to an upper portion of the support member without being attached to a lower portion of the model vehicle. In this case, it is preferable that the coupling part include a pair of contact point pressers which hold a front end portion of the first energization part attached to the support member and a front end portion of the second energization part by protruding downward. In addition, the coupling part may be swingable in line with the support member by being swingably attached to a lower portion of the model vehicle and being engaged with the support member.

A second invention provides a railway model vehicle that includes a vehicle body, a bogie, an energization coupler, and a biasing mechanism. The vehicle body has a shape that is modeled on an appearance of a railway vehicle. The bogie is attached to an attachment shaft of a lower portion of the vehicle body. The energization coupler is attached to a vehicle end portion of the vehicle body. The biasing mechanism is attached between the vehicle body and the energization coupler, and biases the energization coupler to a centering position. The energization coupler includes a coupling part, a support member, a first energization part, and a second energization part. The coupling part has a front end shape detachably engageable with the same kind of coupling partner regardless of an orientation. The support member is swingable in line with the coupling part by extending toward a front end side facing the coupling partner from an attachment base side attached to the attachment shaft and providing a front end under the coupling part. The first energization part is attached to the support member, and includes a first contact point formed on the attachment base side and a second contact point formed on the front end side. The first contact point is in contact with a first power collection member in the vicinity of the attachment shaft, and second contact point is in contact with the fourth contact point of the second energization part of the coupling partner. The second energization part is attached to the support member in a state of being insulated from the first energization part, and includes a third contact point formed on the attachment base side and a fourth contact point formed on the front end side. The third contact point is in contact with a second power collection member in the vicinity of the attachment shaft, and the fourth contact point is in contact with the second contact point of the first energization part of the coupling partner.

Here, in the second invention, the railway model vehicle may further include a guide unit that is provided in the vicinity of the attachment shaft, and enables expansion and contraction of the support member according to curvature of a rail by abutting on the support member. Further, the coupling part may be attached to an upper portion of the support member without being engaged with the lower portion of the vehicle body. The coupling part may swing in line with the support member by being swingably attached to the lower portion of the vehicle body and being engaged with the support member. Furthermore, the configuration according to the first invention described above can be applied to the energization coupler.

A third invention provides a model energization unit that is attached under a coupling unit including a coupling part having a front end shape detachably engageable with the same kind of coupling partner regardless of an orientation. The energization unit includes a support member, a first energization part, and a second energization part. The support member is swingable in line with the coupling part by extending toward a front end side facing the coupling partner from an attachment base side attached to a model vehicle, proving a front end under the coupling part, and engaging the front end with the coupling part. The first energization part is attached to the support member, and includes a first contact point formed on the attachment base side and a second contact point formed on the front end side. The second energization part is attached to the support member in a state of being insulated from the first energization part, and includes a third contact point formed on the attachment base side and a fourth contact point formed on the front end side. The first contact point is in contact with a first power collection member of the model vehicle. The second contact point is in contact with the fourth contact point of the second energization part of the coupling partner. The third contact point is in contact with a second power collection member of the model vehicle. The fourth contact point is in contact with the second contact point of the first energization part of the coupling partner.

Here, in the third invention, the configuration according to the first invention described above can be applied.

According to the present invention, an energization mechanism which mainly includes the first and second energization parts is provided at the support member which is not the coupling part itself but is formed in addition to the coupling part. As a result, it is possible to dispose the energization mechanism with an appropriate and sufficient design margin without hindering the coupling function of the coupling part and without being restricted by the structure and size of the coupling part. As a result, it is possible to realize the stable and favorable energization between the vehicles can be realized regardless of the curvature of the rail.

DETAILED DESCRIPTION

First Embodiment

Figure 1:
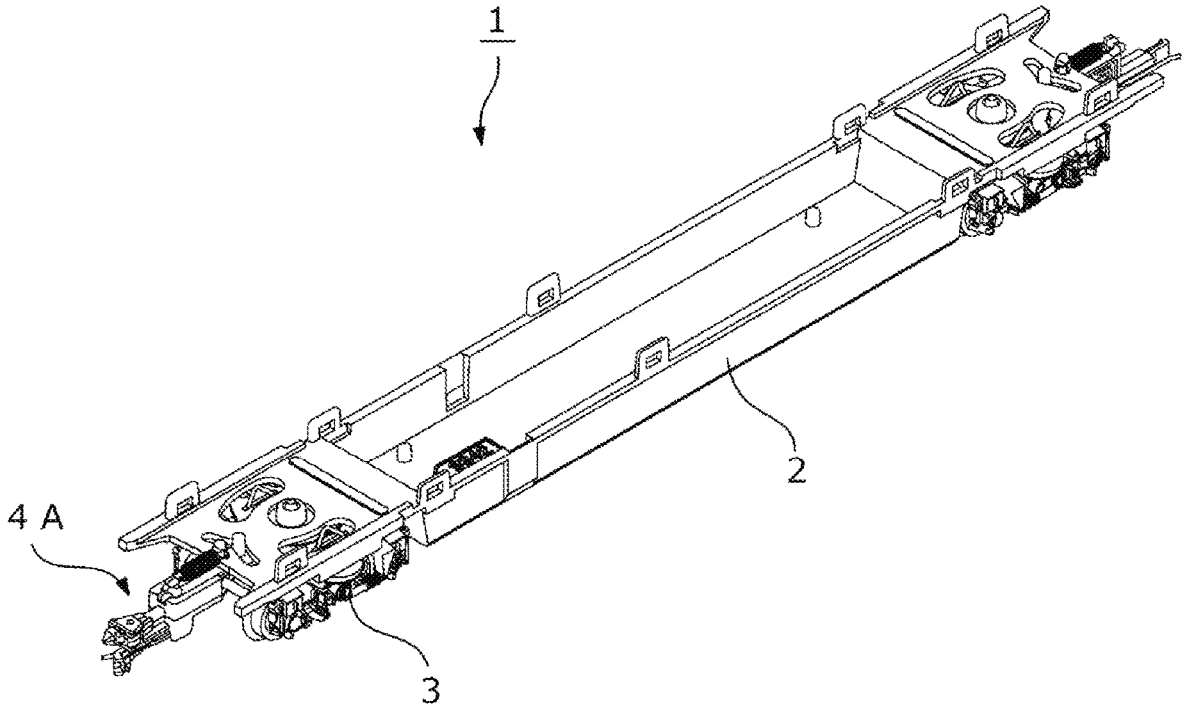
FIG. 1 is a perspective view of a railway model vehicle according to a first embodiment.

FIG. 1 is a perspective view of a railway model vehicle according to a first embodiment. The railway model vehicle 1 is an N-gauge vehicle having a rail spacing, that is, a track gauge of 9 mm, and has a vehicle body 2, a bogie 3, and an energization coupler 4A. The vehicle body 2 has a shape that is modeled on an appearance of an actual railway vehicle. In this drawing, although only a underfloor plate which is a part of the vehicle body 2 is illustrated for the sake of convenience in description, there is a plurality of parts such as a body, a roof board, an indoor board, and a window glass board in addition to the underfloor board in reality, and the vehicle body 2 is constituted by combining these parts. The bogies 3 are swingably attached to a lower portion of the vehicle body 2. The energization coupler 4A is attached to both vehicle end portions of the lower portion of the vehicle body 2. The energization coupler 4A is detachably coupled to the same kind of coupling partner, that is, energization coupler 4A. Although this drawing illustrates a trailer, that is, subordinate vehicle which does not include a motor, the vehicle on which the energization coupler 4A is mounted may be an electric power vehicle.

A first characteristic of the energization coupler 4A is that the vehicles can be detachably coupled to each other, a second characteristic is that electrical power can be supplied between the coupled model vehicles, a third characteristic is that an orientation of the coupling does not matter, and a fourth characteristic is that the energization coupler 4A is stretchable according to the curvature of the rail. Due to the adoption of the energization between the vehicles, since a failure of power collection of a certain vehicle can be complemented by current collection of another vehicle, it is possible to prevent flickering of headlights and indoor lights by contributing to the improvement of the traveling stability of the electric power vehicle. When the energization between all the vehicles is performed during train organization, it is possible to integrate the vehicles as one energization system of the whole train. The present applicant already adopts two types of commercial products for the energization between the vehicles. One type is an energization drawbar which is employed in a two-vehicle coupled type "EH500 electric locomotive" and for which a patent is already obtained as JP 3802307 B by the present applicant. As described in JP 3802307 B, an energization spring is provided at the drawbar that couples the vehicles. However, the coupling between the vehicles is fixed, and the detachment therebetween cannot be performed. The other type is an energization coupler for Shinkansen which is employed in "N700 series Shinkansen". This energization coupler includes a detachable energization spring. However, due to the structure of the coupler, the orientation of the coupling is already determined, and the coupling cannot be performed in a reverse orientation. The present embodiment has been made in order to resolve these drawbacks, and when the vehicles including the energization coupler 4A are used, it is possible to easily realize the energization between the vehicles in any train organization regardless of the types of the vehicles and the orientation of the coupling.

Figure 2:
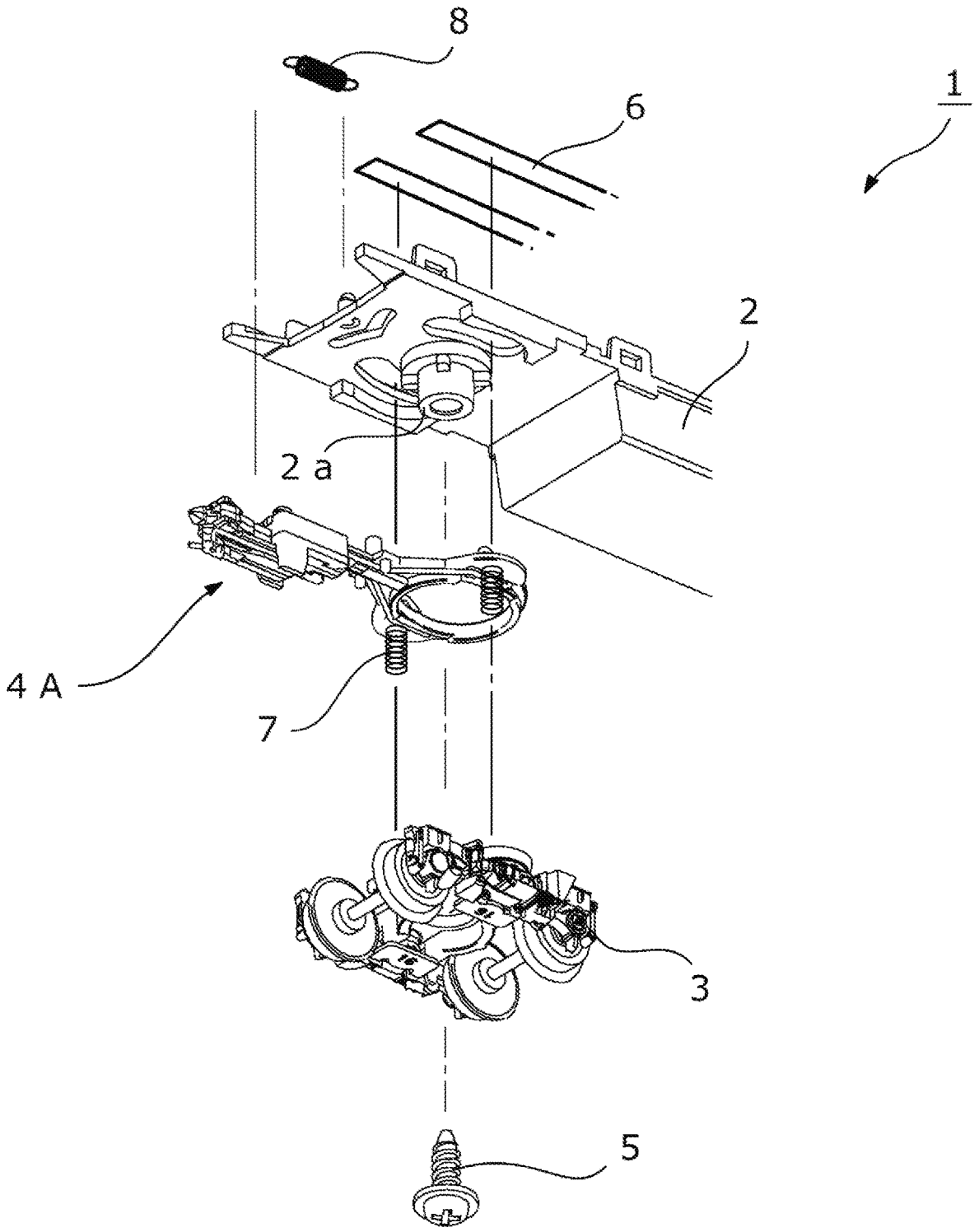
FIG. 2 is a development view of main parts of the railway model vehicle according to the first embodiment.

FIG. 2 is a perspective development view of the railway model vehicle 1. An attachment shaft 2*a* that protrudes downward is provided at the lower portion of the vehicle body 2. An outer peripheral surface of the attachment shaft 2*a* has a stepped portion, and a small diameter portion corresponding to an opening on the bogie 3 side is formed on a front end side, and a large diameter portion corresponding to an opening on the energization coupler 4A side is formed on an attachment base side. The bogie 3 and the energization coupler 4A can be swingably attached to the vehicle body 2 by attaching an attachment screw 5 in a state in which the attachment shaft 2*a* is inserted into these openings. A pair of power collection plates 6 as power collection members are attached to an inside of the railway model vehicle 1, specifically, the underfloor plate which is a part of the vehicle body 2, and a pair of power collection springs 7 are interposed between the bogie 3 and the power collection plate 6. Power supplied to the not illustrated rail is collected in the order of metallic wheels of the bogie 3, the power collection springs 7, and the power collection plates 6, and thus, power necessary for driving the motor and turning on the indoor light is supplied to the railway model vehicle 1. Further, one end of a centering spring 8 as a biasing mechanism is attached to the vehicle body 2, and the other end thereof is attached to the energization coupler 4A. The centering spring 8 constantly biases the energization coupler 4A to a centering position, that is, a neutral position facing a front surface of a vehicle end by using its own elastic force.

Figure 3:
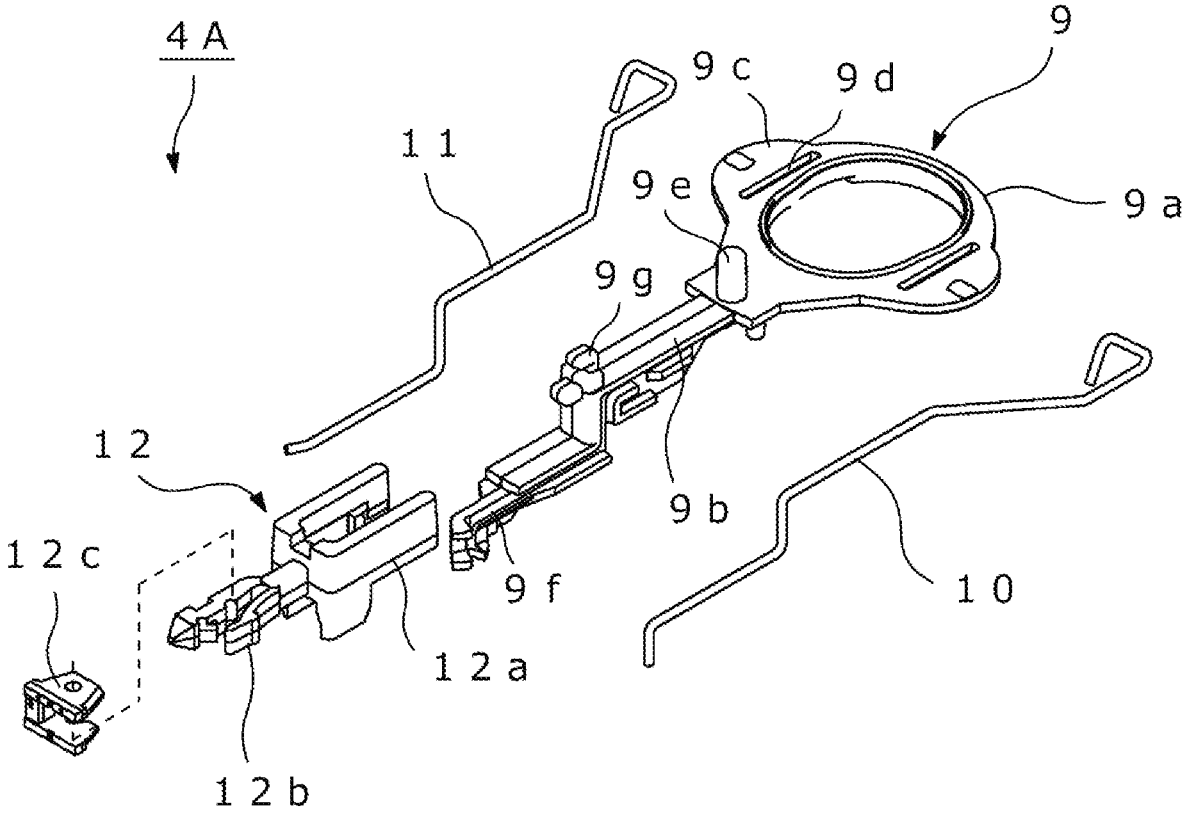
FIG. 3 is a perspective development view of an energization coupler.

FIG. 3 is a perspective development view of the energization coupler 4A. The energization coupler 4A is integrated by combining a support member 9, a pair of energization parts 10 and 11, and coupling parts 12. In the present embodiment, the coupling part 12 is attached to an upper portion of the support member 9 without being attached to the lower portion of the vehicle body 2. The support member 9 is integrally made of an insulating resin material such as soft plastic. A front end of the support member 9 is disposed under the coupling part 12. The support member 9 itself does not have a coupling function of being attached to or detached from a coupling partner, and is used for providing an electrical contact point with the coupling partner.

The support member 9 includes a ring 9*a* and an arm 9*b*. The ring 9*a* is provided on the attachment base side of the support member 9. An oval opening is formed in the ring 9*a*, and the ring 9*a* is inserted into the large diameter portion of the attachment shaft 2*a* as illustrated in FIG. 1. As a result, the support member 9 is swingable side to side in a state in which sliding back and forth is permitted within a range defined by the oval opening. A pair of protrusions 9*c* protruding outward and a pair of slits 9*d* penetrating vertically are formed on the left and right sides of the ring 9*a*. Further, a guide pin 9*e* protruding upward is provided at a center in front of the ring 9*a*. The protrusions 9*c* and the guide pin 9*e* constitute a part of an expansion and contraction mechanism to be described below. Further, the slits 9*d* are used for attaching the energization parts 10 and 11.

Figure 10:
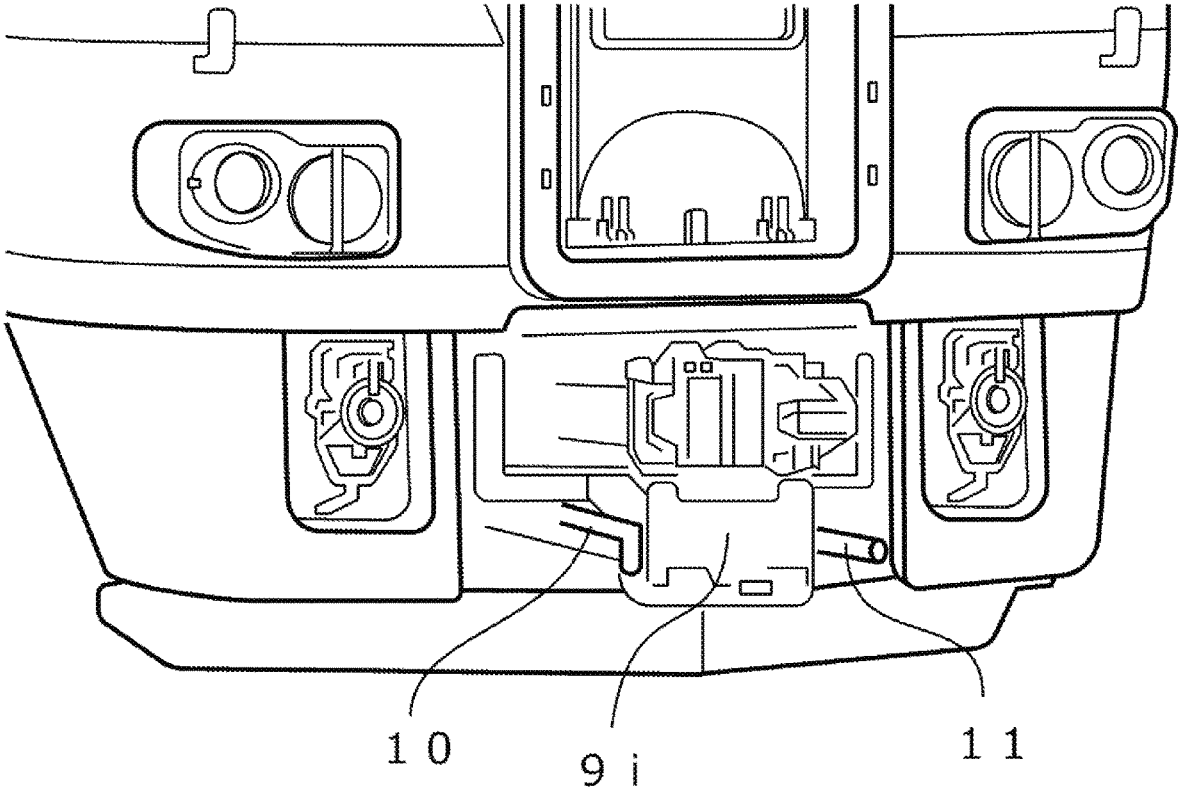
FIG. 10 is an explanatory diagram of an energization coupler according to a third embodiment.

The arm 9*b* extends in an arm shape from the center in front of the ring 9*a* toward the front end side facing the coupling partner. Specifically, the arm 9*b* is bent downward in the middle and then horizontally extends toward the front end side in order to secure a space for accommodating the coupling part 12. A front end of the arm 9*b* is positioned directly under the coupling part 12. In the present embodiment, the entire front end portion of the arm 9*b* does not protrude in a width direction, and only a halved protrusion 9*f* divided vertically in half partially protrudes. The protrusion 9*f* protrudes forward of coupling surface of the coupling part 12 in order to appropriately guide the energization part, that is, the other energization part 11 on the coupling partner side to a desired position. Here, the "coupling surface" is defined as a vertical surface positioned in the middle between the pair of coupling parts 12 coupled to each other. A space present sideward of the protrusion 9*f*, that is, the remaining half of the space in which the protrusion 9*f* is not present functions as a space for accommodating the protrusion 9*f* on the coupling partner side when the energization coupler 4A is coupled. As long as it is possible to secure energization properties, the front end portion of the arm 9*b* may not be a partially halved protrusion, and the entire front end portion thereof may protrude as in the third embodiment to be described below which is illustrated in FIG. 10.

A hook 9*g* is formed in the middle of the arm 9*b*. The hook 9*g* engages with the other end of the centering spring 8 of which one end is attached to the vehicle body 2, and thus, the support member 9 is constantly biased to the centering position. Furthermore, on a lower surface of the ring 9*a* and on left and right side surfaces of the arm 9*b*, grooves and protrusions for supporting the pair of energization parts 10 and 11 are formed along the shapes.

The pair of energization parts 10 and 11 are attached to the support member 9 in a state of being insulated from each other. Although it has been described in the present embodiment that materials acquired by bending a metal wire spring material having excellent elasticity and conductivity into a predetermined shape are used as the energization parts 10 and 11, a metal plate spring material may be used instead of the metal wire spring material. The one energization part 10 is attached to the one slit 9*d* such that an end portion on the attachment base side is bent in a triangular shape and a top thereof protrudes from an upper surface of the support member 9. The energization part 10 is guided to the front end side along a lower portion of the ring 9*a* and one side portion of the arm 9*b*. A front end portion of the energization part 10 is bent downward without protruding forward of the coupling surface of the coupling part 12, and is supported by a side portion of the protrusion 9*f*.

The other energization part 11 is attached to the other slit 9*d* such that an end portion on the attachment base side is bent in a substantially triangular shape and a vertex thereof protrudes from the upper surface of the support member 9. The energization part 11 is guided to the front end side along the lower portion of the ring 9*a* and the other side portion of the arm 9*b*. A front end portion of the energization part 11 is different from the front end portion of the energization part 10, extends horizontally while being obliquely widened sideward without being bent downward, and is disposed so as to be separated sideward from the protrusion 9*f*. Further, the front end portion of the energization part 11 is disposed slightly under than the energization part 10, and protrudes forward of the coupling surface of the coupling part 12. A positional relationship between the energization parts 10 and 11 may be reversed.

The coupling part 12 is attached to the upper portion of the support member 9 without engaging with the lower portion of the vehicle body 2. The coupling part 12 is made of an insulating resin material such as soft plastic, and includes a coupling end 12*b* protruding forward from a body 12*a*. The coupling end 12*b* has a shape detachably engageable with the same kind of coupling partner regardless of an orientation. A shape and a structure of the coupling end 12*b* are similar to a shape and a structure of a product group called "TN coupler" which is registered trademark of Takara Tomy Co., Ltd. which has a reputation for high reality and easiness of detachment. In the case of the illustrated tight coupling type, the coupling end has a structure in which a frame 12*c* is attached to a comb-like portion having an engagement claw. The shape of the coupling end 12*b* may be a shape of an automatic tight coupling type in addition to the shape of the tight coupling type, or may be a shape modeled on various couplers provided in a foreign railway vehicle.

Figure 4:
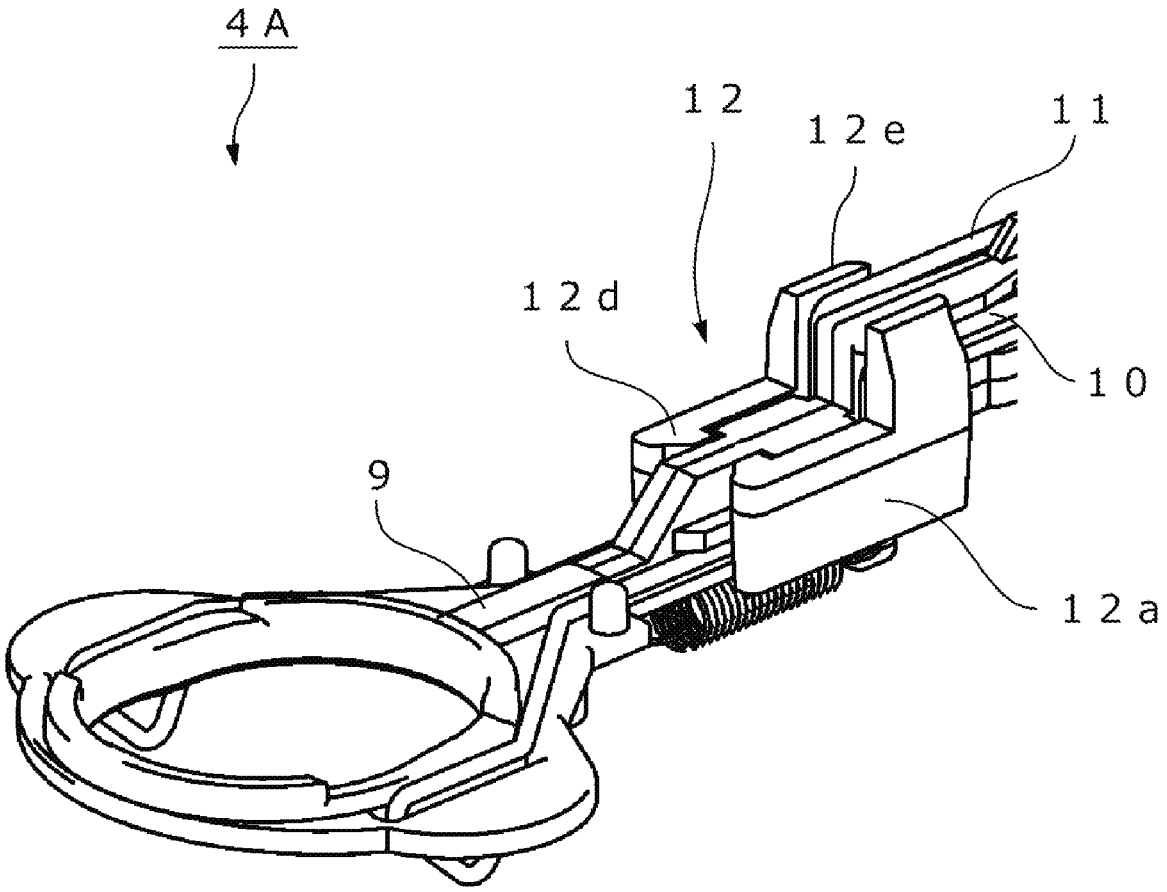
FIG. 4 is an enlarged view of main parts of the energization coupler.

FIG. 4 is an enlarged view of main parts of the energization coupler 4A in bottom view. A pair of engagement claws 12*d* and a pair of contact point pressers 12*e* are provided on the left and right sides of the body 12*a* which is a part of the coupling part 12. The pair of engagement claws 12*d* engages with left and right side portions of the support member 9, and thus, the coupling part 12 fitted from the front end side of the support member 9 is fixed to the upper surface of the support member 9. The pair of contact point pressers 12*e* protrudes downward from the body 12*a*. These contact point pressers 12*e* abut on or are close to the left and right side portions of the support member 9, and hold the front end portions of the energization parts 10 and 11. As a result, the positions of the front end portions of the energization parts 10 and 11 are restricted so as not to be widened outward, and the positions of the contact points 10*b* and 11*b* to be described below are stabilized.

Figure 5:
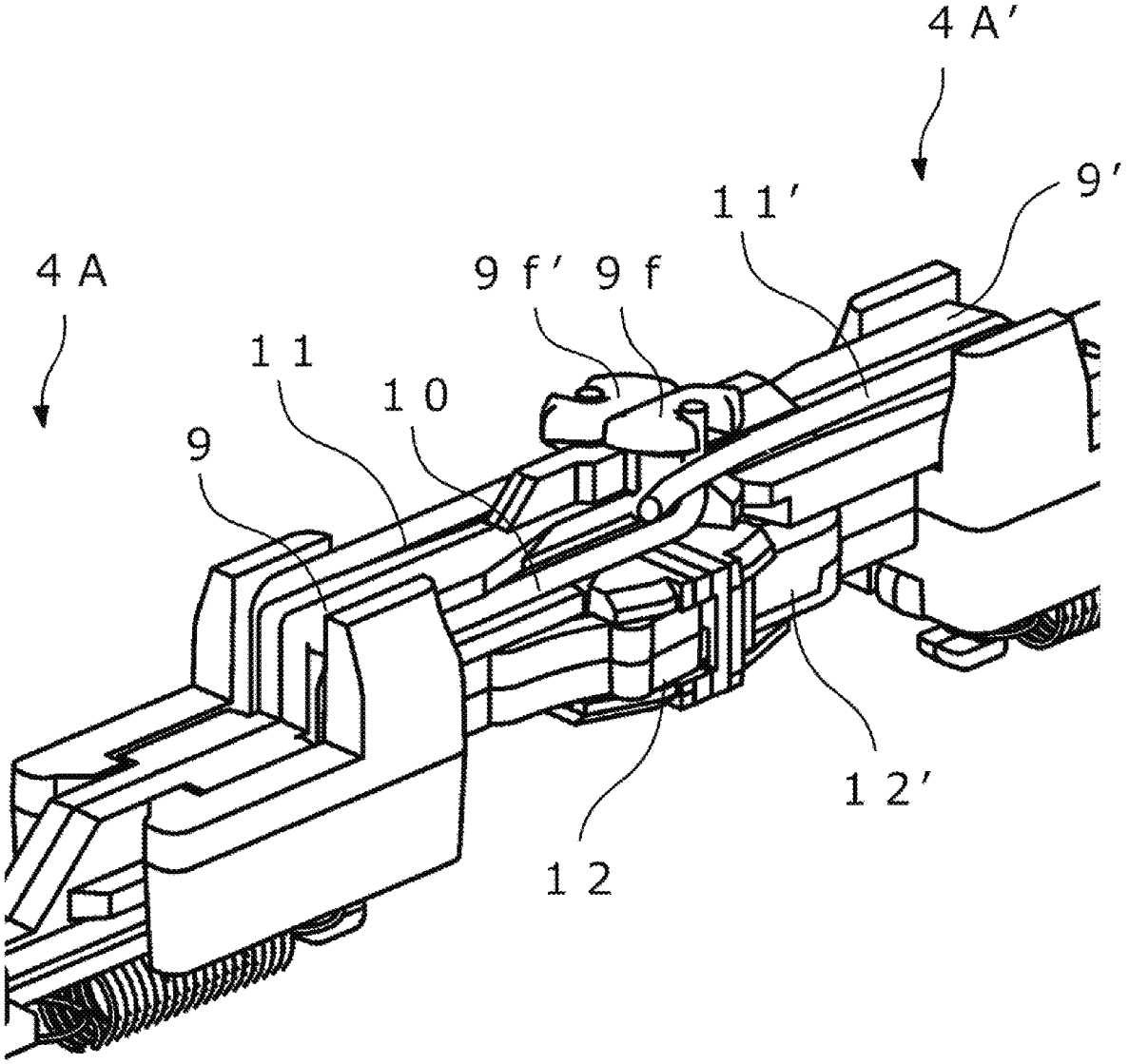
FIG. 5 is an enlarged view of the main parts of the energization coupler in a coupled state.

FIG. 5 is an enlarged view of the main parts of the energization couplers 4A and 4A' in the coupled state in bottom view. In a state in which the coupling parts 12 and 12' facing each other are engaged, the protrusions 9*f* and 9*f'* are partially overlapped in a front-rear direction, and the side portions thereof are in contact with each other. As a result, the movement of the support members 9 and 9' is restricted, and the integrity is maintained so as to be a substantially straight line regardless of the curvature and slope of the rail. This is advantageous in enhancing the stability of the energization between the vehicles under various traveling conditions.

Further, one energization part 10 on the energization coupler 4A side is aligned at the same side portion as the other energization part 11' on the energization coupler 4A' side. The energization part 11' extends so as to exceed the coupling surfaces of the coupling parts 12 and 12', and protrudes toward the energization coupler 4A side. As a result, the horizontal front end portion of the energization part 11' is in contact with the downwardly bent front end portion of the energization part 10 while being slightly bent sideward against an elastic force of the horizontal front end portion, and thus, these front end portions are energized. Further, the other energization part 11 on the energization coupler 4A side is aligned at the same side portion as one energization part which is not illustrated on the energization coupler 4A' side. The energization part 11 extends so as to exceed the coupling surface, and protrudes toward the energization coupler 4A' side. As a result, the horizontal front end portion of the energization part 11 is in contact with the downwardly bent front end portion of the energization coupler 4A' while being slightly bent sideward against the elastic force, and thus, these front end portions are energized.

Figure 6:
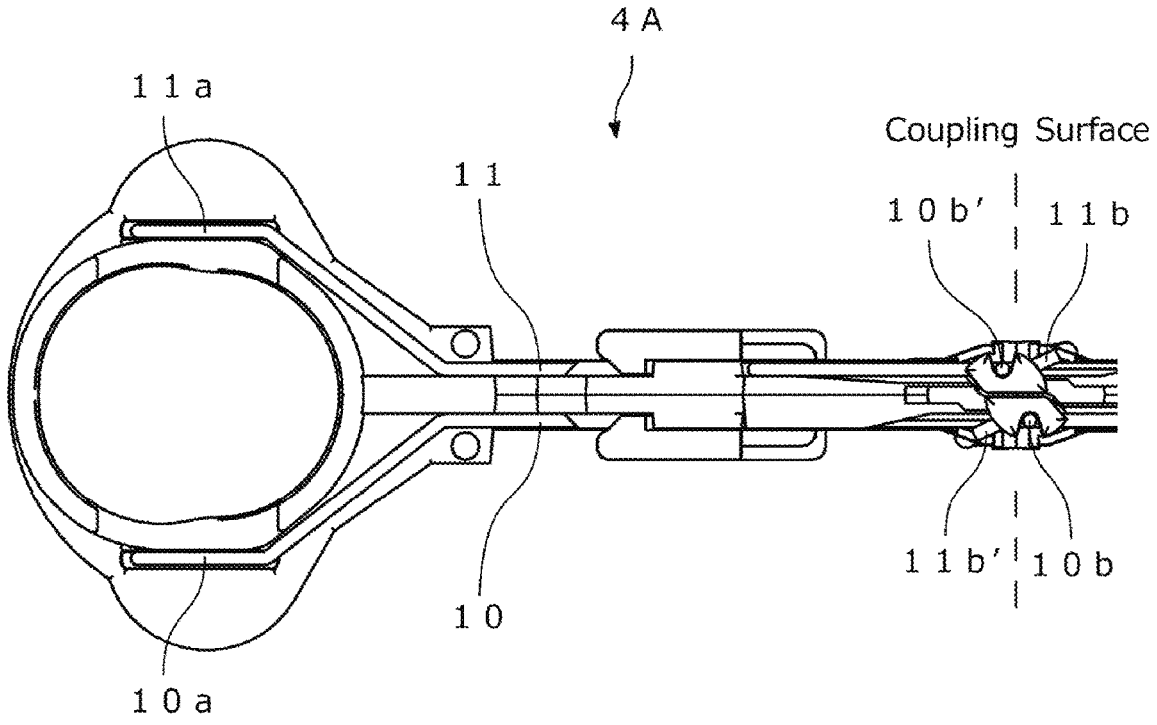
FIG. 6 is an explanatory diagram of contact points of an energization part in the energization coupler.

FIG. 6 is an explanatory diagram of the contact points of the energization parts 10 and 11 in the energization coupler 4A. One energization part 10 includes a first contact point 10*a* provided on the attachment base side and a second contact point 10*b* provided on the front end side. Moreover, the other energization part 11 includes a third contact point 11*a* provided in the attachment base side and a fourth contact point 11*b* provided in the front end side. Here, the first contact point 10*a* is in contact with one power collection plate 6 which is illustrated in FIG. 2 provided in the vehicle body 2, more specifically, in the vicinity of the attachment shaft 2*a*. The contact point 10*a* corresponds to a vertex of a triangle provided at one end of the energization part 10. The second contact point 10*b* is in contact with the fourth contact point 11*b'* on the coupling partner side. The contact point 10*b* corresponds to the downwardly bent front end portion provided at the other end portion of the energization part 10. For example, the contact point 10*b* has a bent shape, and thus, it is possible to stably maintain a contact state between these points even though the position of the fourth contact point 11*b'* is displaced in a height direction at the time of entering the slope. The third contact point 11*a* is in contact with the other power collection plate 6 which is illustrated in FIG. 2 provided in the vehicle body 2, more specifically, in the vicinity of the attachment shaft 2*a*. The contact point 11*a* corresponds to a vertex of a triangle provided at one end of the energization part 11. The fourth contact point 11*b* is in contact with the second contact point 10*b*' on the coupling partner side. The contact point 11*b* corresponds to the horizontally extending front end portion provided at the other end portion of the energization part 11. The contact point 11*b* protrudes forward of the coupling surface of the coupling part 12 and forward of the second contact point 10*b*.

Figure 7:
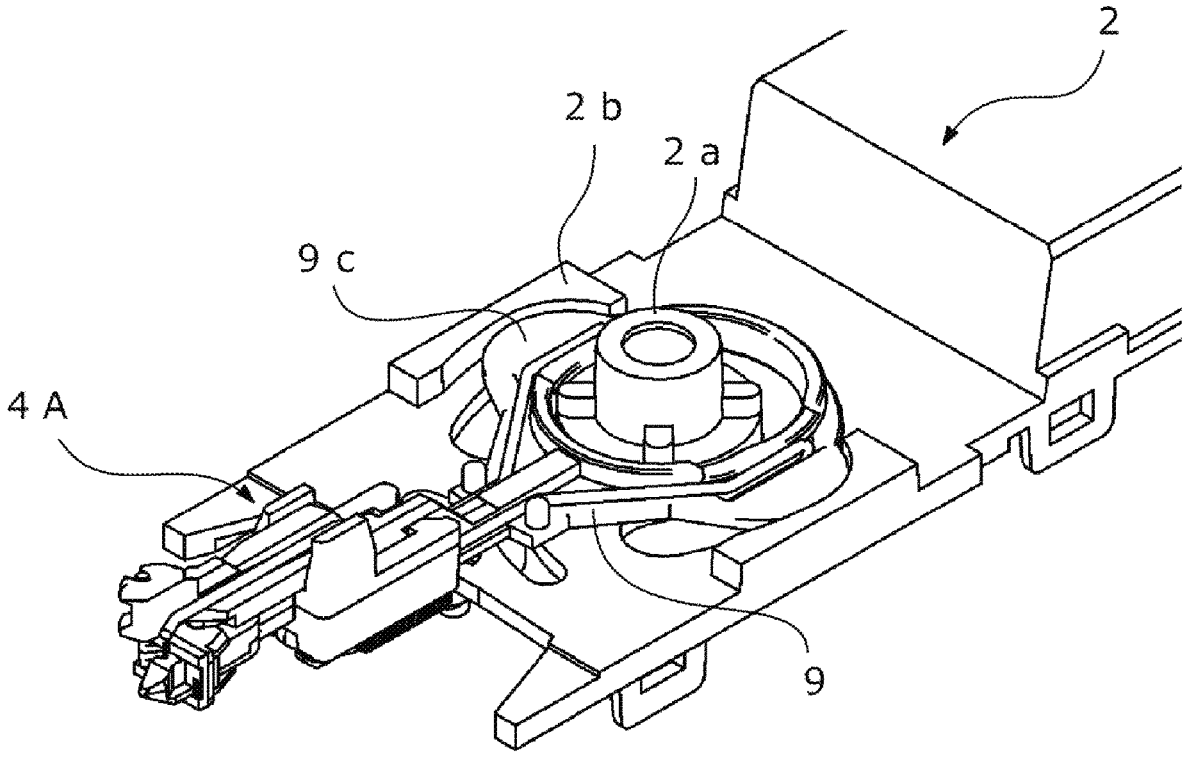
FIG. 7 is a perspective view of the energization coupler attached to the model vehicle.

In the present embodiment, as one function of the energization coupler 4A, an expansion mechanism which expands and contracts the energization coupler 4A is provided according to the curvature of the rail. As illustrated in FIG. 7, this expansion mechanism mainly includes a pair of guides 2*b* and a pair of protrusions 9*c*. The pair of guides 2*b* are formed at the vehicle body 2 side, more specifically, in the vicinity of the left and right sides of the attachment shaft 2*a* to which the energization coupler 4A is attached. Further, as described above, the pair of protrusions 9*c* are formed so as to protrude toward the energization coupler 4A side, more specifically, to the left and right sides of the support member 9.

Figure 8:
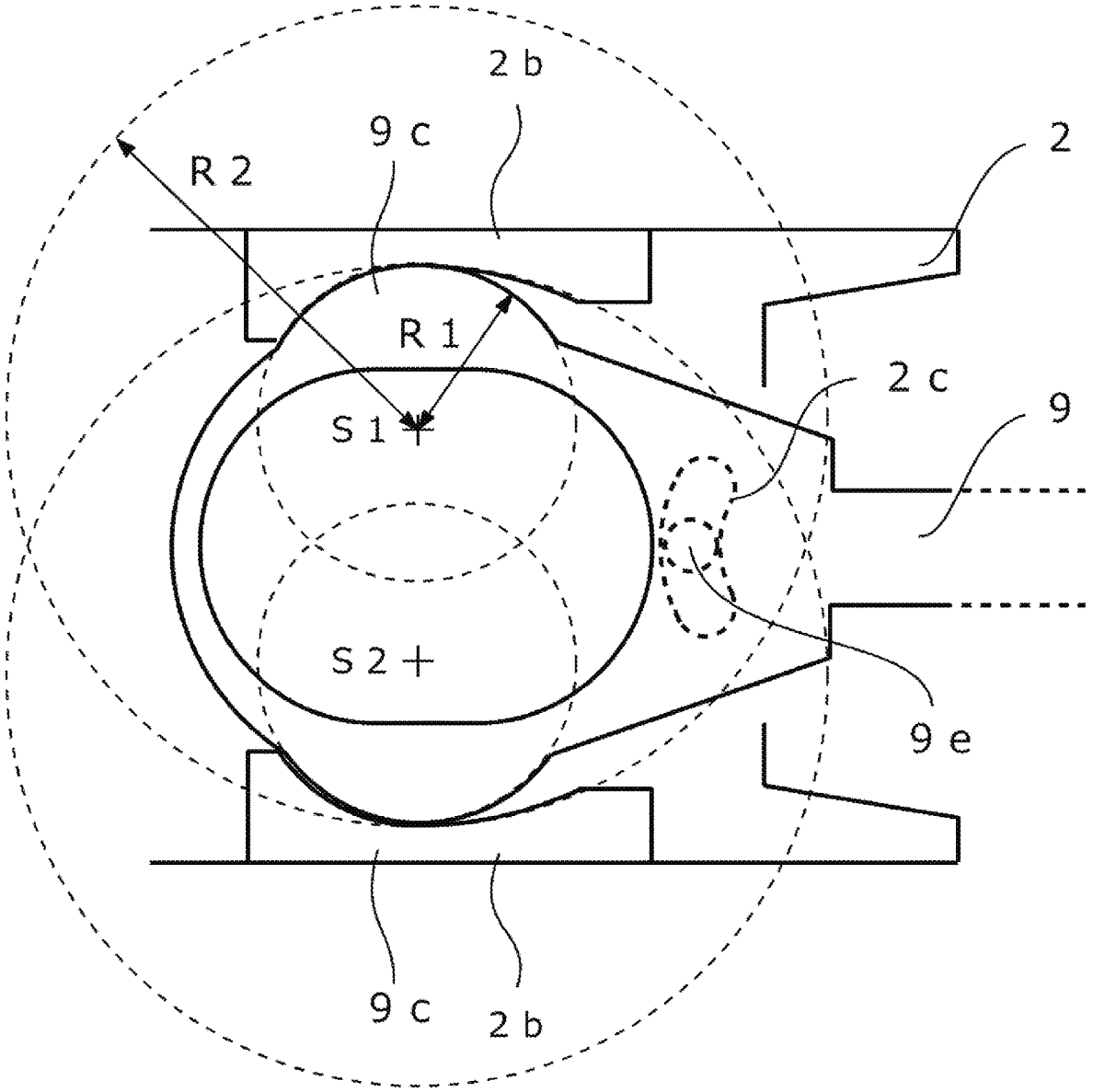
FIG. 8 is an explanatory diagram of an expansion and contraction mechanism of the energization coupler.

A configuration and an operation of the expansion mechanism will be described with reference to FIG. 8. Two separated centers S1 and S2 are defined on a straight line in a vehicle width direction. An outer edge of one protrusion 9*c* is set as an arc having a small diameter R1 with the center S1, and an outer edge of the other protrusion 9*c* is set as an arc having a small diameter R1 with the center S2. An inner edge of one guide 2*b* is set as a continuous curve that connects a rear arc having the small diameter R1 with the center S1 and a front arc having a large diameter R2 which satisfies R2>R1 with the center S2. An inner edge of the other guide 2*b* is set as a continuous curve that connects a front arc having the small diameter R1 with the center S2 and a rear arc having the large diameter R2 with the center S1. A guide pin 9*e* formed at the support member 9 is engaged with a V-shaped or U-shaped guide groove 2*c* formed in the vehicle body 2.

During traveling on a straight line, the energization coupler 4A is positioned at the centering position, and the guide pin 9*e* guided by the guide groove 2*c* is positioned at a deepest position. In this case, the energization coupler 4A is in a most contracted state, and a coupling distance is, for example, about 3.3 mm. In contrast, during traveling on a curve, the outer edge of the protrusion 9*c* slides along the inner edge of the guide 2*b*, and the support member 9, that is, energization coupler 4A swings side to side. For example, about 17.4 degrees with the attachment shaft 2*a* as a center can be secured as a swing range. In this case, one protrusion 9*c* abuts on the rear inner edge (small diameter R1) of one guide portion 2*b*, and the other protrusion 9*c* protrudes forward along the front inner edge having a large diameter R2 of the other guide 2*b*. As a result, the support member 9 extends forward as the curvature of the curve increases. The expansion and contraction as described above enables the passage of a curved rail having a minimum radius of 243 mm while narrowing the coupling distance at the centering position. The details of the present expansion and contraction mechanism are described in JP 3802307 B, and are referred to if necessary.

As stated above, according to the present embodiment, an energization mechanism which mainly includes the energization parts 10 and 11 is provided at the support member 9 which is not the coupling part 12 itself but is formed in addition to the coupling part 12, and does not have a coupling function. As a result, it is possible to dispose the energization mechanism with an appropriate and sufficient design margin without hindering the coupling function of the coupling part 12 and without being restricted by the structure and size of the coupling part 12. As a result, it is possible to realize the stable and favorable energization between the vehicles with no separation of the contact points to be in contact with each other even during traveling on an extremely tight curve having a minimum radius of 243 mm, and it is possible to effectively suppress the knocking of the motor caused due to dirt or flickering of the headlights or indoor lights.

Further, according to the present embodiment, since the support member 9 is disposed under the coupling part 12, the support member 9 is less noticeable in the railway model vehicle 1 which is frequently viewed from diagonally above, and thus, it is possible to secure the reality of the railway model vehicle 1.

Further, according to the present embodiment, the fourth contact point 11*b* of the other energization part 11 protrudes forward of the coupling surface of the coupling part 12 and forward of the second contact point 10*b* of one energization part 10. As a result, it is possible to further improve the stability of the energization between the vehicles.

Furthermore, according to the present embodiment, the front end portion of one energization parts 10 is bent downward and the front end portion of the other energization part 11 is obliquely widened sideward, and thus, it is possible to effectively secure the stability of the energization between the vehicles even when a thin wire spring material is used as the energization parts 10 and 11. At this time, when the energization coupler 4A is coupled, it is possible to favorably guide the front end portion of the other energization part 11 to the coupling partner side.

Second Embodiment

Figure 9:
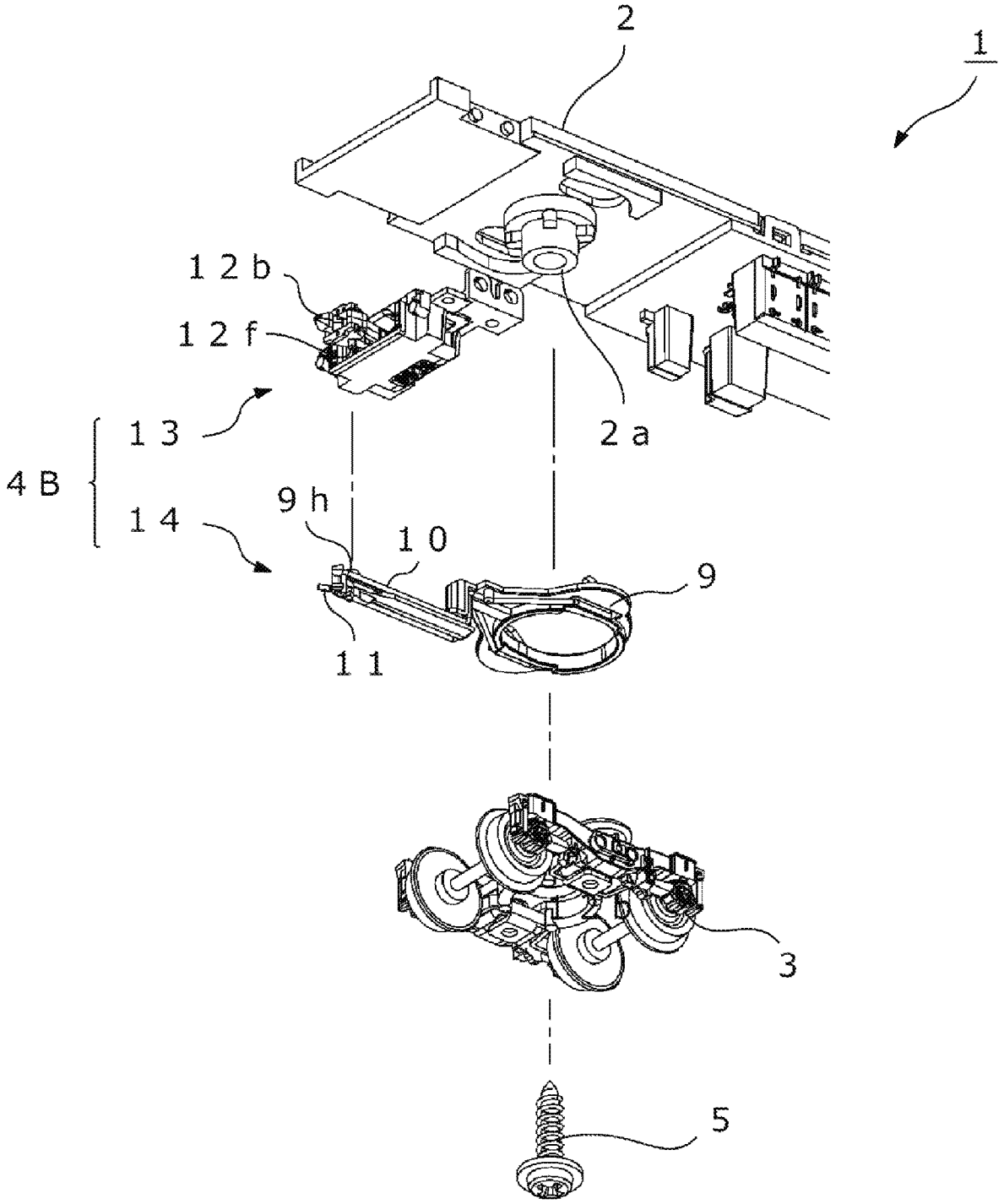
FIG. 9 is a development view of main parts of a railway model vehicle according to a second embodiment.

FIG. 9 is a development view of main parts of a railway model vehicle according to a second embodiment. The characteristics of the present embodiment are that an energization coupler 4B is formed by dividing the energization coupler 4A according to the first embodiment into the coupling unit 13 and the energization unit 14 and combining these separate units. The coupling unit 13 swings in line with the support member 9 by attaching the coupling part to the lower portion of the vehicle body 2 in a state in which the coupling part is swingable and engaging the coupling part with the support member 9 on the energization unit 14 side. Hereinafter, the characteristic parts of the present embodiment will be described. Here, the same matters as the matters of the first embodiment will be assigned the same reference numerals, and the description thereof will be omitted.

The coupling unit 13 is attached to a lower end portion of the vehicle body 2. The coupling unit 13 includes a swingable coupling end 12*b* protruding forward. The coupling end 12*b* has a shape detachably engageable with the same kind of coupling partner regardless of the orientation, is swingable side to side, and expands and contracts back and forth. A basic configuration of the coupling unit 13 is the same as the existing body-mounted tight coupling type TN coupler or automatic tight coupling type TN coupler, but is different in that a protrusion protruding downward as a first engagement portion 12*f* is formed under the coupling end 12*b*, that is, a TN coupler for energization is used.

The energization unit 14 is disposed under the coupling unit 13, and is swingably attached to the attachment shaft 2*a*. The energization unit 14 is basically acquired by excluding the coupling part 12 from the energization coupler 4A according to the first embodiment, and includes the support member 9 and the pair of energization parts 10 and 11. A recess having a shape capable of being engaged with the first engagement portion 12*f* on the coupling unit 13 side is formed as a second engagement portion 9*h* on the upper surface of the front end of the support member 9 positioned under the coupling end 12*b*. In addition, in order to hold the front end portions of the energization parts 10 and 11, it is preferable that the contact point pressers 12*e* provided on the coupling part 12 side in the first embodiment be provided on the support member 9 side.

The coupling part, specifically, coupling end 12*b* on the coupling unit 13 side is integrated with the support member 9 on the energization unit 14 side by engaging the first engagement portion 12*f* with the second engagement portion 9*h*, and both are swingable in line with each other. As a result, the energization coupler 4B having the same function as the energization coupler 4A according to the first embodiment is realized.

As stated above, according to the present embodiment, it is possible to easily realize the energization coupler 4B having compatibility with the existing product by simply changing the existing product slightly in addition to the same actions and effects as the first embodiment. As a realization mode of the energization coupler 4B, a mode in which both the coupling unit 13 and the energization unit 14 are attached to the model vehicle from the beginning may be used, or a mode in which the user separately purchases the energization unit 14 and attach the purchased energization part to the model vehicle to which only the coupling unit 13 is attached later. When the latter mode is assumed, the energization unit 14 itself becomes an object for sales and distribution as an extended part.

Third Embodiment

FIG. 10 is an explanatory diagram of a energization coupler according to a third embodiment. Characteristics of the present embodiment are that the front end surface 9*i* of the support member 9 has a shape that is modeled on an appearance of an electrical coupler of a real vehicle in the energization couplers 4A and 4B according to the aforementioned embodiments. For example, in some vehicle types such as the KiHa 181 series diesel trains, an electrical coupler is adopted, and a cover for protecting an electrode is attached directly under a coupler body. Thus, in the railway model vehicle 1, when the front end 9*i* of the support member 9 has an appearance shape that looks like an actual cover, it is possible to improve the reality of the railway model vehicle 1.

Figure 11:
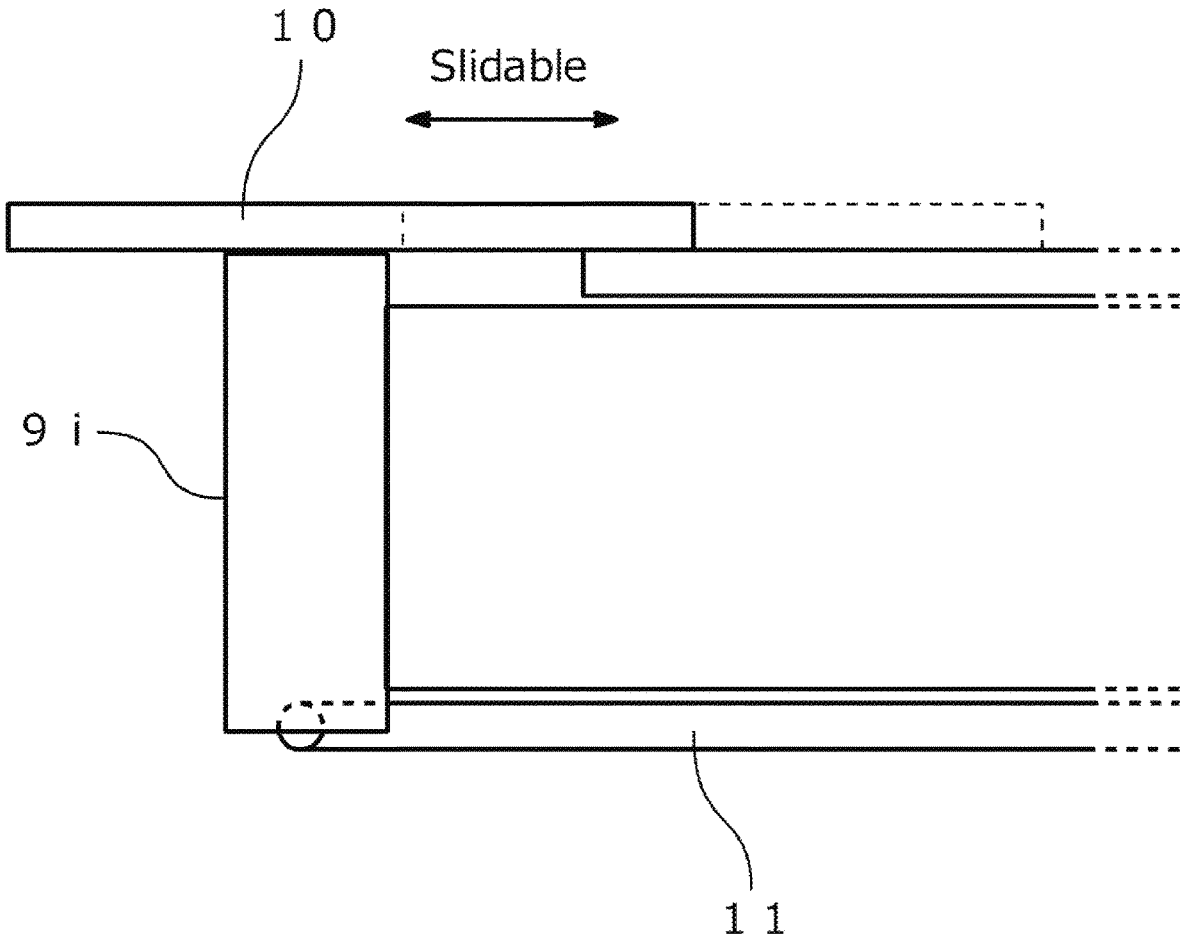
FIG. 11 is an explanatory diagram of a slide mechanism.

In this case, in particular, when an attachment target of the energization couplers 4A and 4B is a leading vehicle, the energization parts 10 and 11 are exposed to the front surface, and thus, there is a concern that the reality may be deteriorated. Thus, as illustrated in FIG. 11, at least one of the energization parts 10 and 11 may be switched between a used state in which the energization part is slidable back and forth and protrudes from the front end 9*i* of the support member 9 and a unused state in which the energization part is accommodated within the support member 9, that is, inner than the front end 9*i*. When the railway model vehicle 1 is positioned in the middle in the train organization, the energization part is set to the used state, and when the railway model vehicle 1 is positioned at the head or the tail in the train organization, the energization part is set to the unused state. Other cases are basically the same as the aforementioned embodiments, and thus, the description thereof will be described.

As stated above, according to the present embodiment, it is possible to further improve the reality of the railway model vehicle 1 in addition to the same actions and effects as the aforementioned embodiments.

Although it has been described in the aforementioned embodiments that the N-gauge vehicle is used as the example of the model vehicle, the present invention is also applicable to other railway model specifications including a HO gauge. Moreover, the model vehicle is widely applicable not only to the railway model vehicle but also to various model vehicles having a need for the energization between the vehicles.

What is claimed is:

1. A model energization coupler for a model vehicle having a coupling part with a front end shaped for detachably coupling with a coupling part of a second model vehicle, wherein the coupling part of the model vehicle has a same configuration as the coupling part of the second model vehicle, and a support member attached to the coupling part of the model vehicle and having an attachment base side rotatably attached to the model vehicle and a front end side that extends outwardly away from the model vehicle and is formed under the coupling part of the model vehicle, the model energization coupler comprising:

a first energization part that is attached to the support member, and includes a first contact point formed on the attachment base side and a second contact point formed on the front end side; and a second energization part that is attached to the support member in a state of being insulated from the first energization part, and includes a third contact point formed on the attachment base side and a fourth contact point formed on the front end side, wherein the first contact point is in contact with a first power collection member of the model vehicle, the second contact point is configured to contact with a fourth contact point of a second energization part of the second model vehicle, the third contact point is in contact with a second power collection member of the model vehicle, and the fourth contact point is configured to contact with a second contact point of a first energization part of the second model vehicle.

2. The model energization coupler according to claim 1, wherein the fourth contact point protrudes forward of a coupling surface of the coupling part and forward of the second contact point.

3. The model energization coupler according to claim 1, wherein the first energization part is attached to one side portion of the support member, and the second energization part is attached to the other side portion of the support member.

4. The model energization coupler according to claim 3, wherein a front end portion of the first energization part is bent downward, and a front end portion of the second energization part is obliquely widened sideward.

5. The model energization coupler according to claim 1, wherein the support member includes a protrusion that partially extends toward the front end side, protrudes forward of a coupling surface of the coupling part, and supports a front end portion of the first energization part, a protrusion of the coupling partner is configured to be accommodated in a space present on a side of the protrusion, and a front end portion of the second energization part is disposed so as to be separated sideward from the protrusion.

6. The model energization coupler according to claim 5, wherein movement of the support member is configured to be restricted by contacting the protrusion of the coupling part with a protrusion of the second model vehicle in a state of being coupled to the second model vehicle.

7. The model energization coupler according to claim 1, further comprising:

a biasing mechanism that biases the support member to a centering position.

8. The model energization coupler according to claim 1, wherein a front end surface of the support member has a shape that is modeled on an appearance of an electrical coupler of a real vehicle.

9. The model energization coupler according to claim 8, wherein at least one of the first energization part and the second energization part is slidable, and is switchable between a state of protruding from the front end surface of the support member and a state of being accommodated in the support member.

10. The model energization coupler according to claim 1, wherein the coupling part is attached to an upper portion of the support member without being attached to a lower portion of the model vehicle.

11. The model energization coupler according to claim 10, wherein the coupling part includes a pair of contact point pressers which hold a front end portion of the first energization part attached to the support member and a front end portion of the second energization part by protruding downward.

12. The model energization coupler according to claim 1, wherein the coupling part is swingable in line with the support member by being swingably attached to a lower portion of the model vehicle and being engaged with the support member.

13. A railway model vehicle comprising:

a vehicle body that is modeled on an appearance of a railway vehicle;

a bogie that is attached to an attachment shaft of a lower portion of the vehicle body;

an energization coupler that is attached to a vehicle end portion of the vehicle body; and a biasing mechanism that is attached between the vehicle body and the energization coupler, and biases the energization coupler to a centering position, wherein the energization coupler includes a coupling part with a front end shaped for detachably coupling with a coupling part of a second model vehicle, wherein the coupling part of the model vehicle has a same configuration as the coupling part of the second model vehicle, a support member that is attached to the coupling part of the model vehicle and has an attachment base side rotationally attached to the model vehicle and a front end side that extends outwardly away from the model vehicle and is formed under the coupling part of the model vehicle, a first energization part that is attached to the support member, and includes a first contact point formed on the attachment base side and a second contact point formed on the front end side, and a second energization part that is attached to the support member in a state of being insulated from the first energization part, and includes a third contact point formed on the attachment base side and a fourth contact point formed on the front end side, the first contact point is in contact with a first power collection member in a vicinity of the attachment shaft, the second contact point is configured to contact with a fourth contact point of a second energization part of the second model vehicle, the third contact point is in contact with a second power collection member in a vicinity of the attachment shaft, and the fourth contact point is configured to contact with a second contact point of a first energization part of the second model vehicle.

14. The railway model vehicle according to claim 13, further comprising:

a guide unit that is provided in a vicinity of the attachment shaft, and enables expansion and contraction of the support member according to curvature of a rail by abutting on the support member.

15. The railway model vehicle according to claim 13, wherein the coupling part is attached to an upper portion of the support member without being engaged with a lower portion of the vehicle body.

16. The railway model vehicle according to claim 13, wherein the coupling part rotates in association with the support member by being rotatably attached to the lower portion of the vehicle body and being engaged with the support member.

17. A model energization unit for a model vehicle, that is attached under a coupling unit including a model energization coupler having a coupling part with a front end shaped for detachably coupling with a coupling part of a second model vehicle, wherein the model energization coupler has a same configuration as a model energization coupler of the second model vehicle, and a support member attached to the coupling part of the model vehicle and having an attachment base side rotatably attached to the model vehicle and a front end side that extends outwardly away from the model vehicle and is formed under the coupling part, the model energization unit comprising:

a first energization part that is attached to the support member, and includes a first contact point formed on the attachment base side and a second contact point formed on the front end side; and a second energization part that is attached to the support member in a state of being insulated from the first energization part, and includes a third contact point formed on the attachment base side and a fourth contact point formed on the front end side, wherein the first contact point is in contact with a first power collection member of the model vehicle, the second contact point is configured to contact with a fourth contact point of a second energization part of the second model vehicle, the third contact point is in contact with a second power collection member of the model vehicle, and the fourth contact point is configured to contact with a second contact point of a first energization part of the second model vehicle.

* * * * *